US006766772B2

(12) United States Patent
Van Dongen et al.

(10) Patent No.: US 6,766,772 B2
(45) Date of Patent: Jul. 27, 2004

(54) APPARATUS FOR HEATING STEAM

(75) Inventors: Franciscus Gerardus Van Dongen, Amsterdam (NL); Johannes Didericus De Graaf, Amsterdam (NL)

(73) Assignee: Shell Oil Company, Houston, TX (US)

( * ) Notice: Subject to any disclaimer, the term of this patent is extended or adjusted under 35 U.S.C. 154(b) by 29 days.

(21) Appl. No.: 10/276,591

(22) PCT Filed: May 18, 2001

(86) PCT No.: PCT/EP01/05810

§ 371 (c)(1),
(2), (4) Date: Nov. 18, 2002

(87) PCT Pub. No.: WO01/90641

PCT Pub. Date: Nov. 29, 2001

(65) Prior Publication Data

US 2003/0168022 A1 Sep. 11, 2003

(30) Foreign Application Priority Data

May 19, 2000 (EP) ..... 00304263

(51) Int. Cl.[7] ..... F22B 1/02

(52) U.S. Cl. ..... 122/20 B; 122/31.1; 122/483; 165/140

(58) Field of Search ..... 122/31.1, 30, 20 B, 122/15.1, 18.1, 450, 483, 487, 489; 165/157, 140, 96, 299, 911

(56) References Cited

U.S. PATENT DOCUMENTS

| | | | | |
|---|---|---|---|---|
| 3,267,907 A | * | 8/1966 | Glausser et al. | 122/34 |
| 4,178,907 A | * | 12/1979 | Sweat, Jr. | 261/39.1 |
| 4,488,513 A | * | 12/1984 | Jahnke et al. | 122/32 |
| 5,307,766 A | | 5/1994 | Pearce | 22/5 |
| 5,799,620 A | * | 9/1998 | Cleer et al. | 122/31.2 |

FOREIGN PATENT DOCUMENTS

| | | | |
|---|---|---|---|
| EP | 0 199 251 | 10/1986 | F22B/1/18 |
| EP | 0 272 378 A1 | 6/1988 | C07C/11/04 |
| JP | 05 248604 | 9/1993 | F22G/5/12 |

* cited by examiner

*Primary Examiner*—Gregory Wilson

(57) ABSTRACT

An apparatus for heating steam formed from cooling water in a heat exchanger for hot gas, having a superheater arranged in the heat exchanger vessel; a process for heating steam performed in such an apparatus; and a process for gasification of a hydrocarbonaceous feedstock involving such a process for heating steam.

16 Claims, 3 Drawing Sheets

APPARATUS FOR HEATING STEAM

FIELD OF THE INVENTION

The present invention relates to an apparatus for heating steam formed from cooling water in a heat exchanger for hot gas, comprising a primary heat-exchanger vessel having a compartment for cooling water, an inlet for the gas to be cooled, an outlet for cooled gas, an outlet for heated steam and a collecting space for maintaining generated steam. In the compartment for cooling water at least one primary evaporator tube is positioned through which, when in use, the hot gas flows. Due to heat exchange between cooling water and the hot gas via the evaporator tube walls the water evaporates and steam is formed. The steam flows upwards to the collecting space for maintaining generated steam. This steam is further heated in a secondary tube-shell heat exchanger vessel, also referred to as the 'super heater module', positioned in the compartment for cooling water. In such a super heater module the generated steam is heated against the gas, which has been partially reduced in temperature in the primary evaporator tube.

BACKGROUND OF THE INVENTION

Such an apparatus is described in EP-A-257719. The apparatus disclosed in this publication consists of a submerged superheater module, consisting of a shell-tube heat exchanger, wherein the partially cooled gas is fed to the shell side of the superheater module and the steam to the tube side of the superheater module. The two flows are contacted in the superheater in a co-current mode of operation.

Applicants found that when the apparatus according to EP-A-257719 is used to cool gas comprising contaminants such as carbon, ash and/or sulphur, which is for example the case for synthesis gas produced by gasification of a gaseous or liquid hydrocarbonaceous feedstock, leakage can occur. It is believed that fouling of the apparatus at the gas side causes leakage. Although the apparatus was cleaned regularly the leakage problems persisted. Fouling, especially when the synthesis gas is produced by gasification of a liquid hydrocarbon, in particular heavy oil residues, will also result in that the heat exchange capacity of the apparatus will gradually decrease with run time. As a result, the temperature of the process gas leaving the heat exchanger will increase gradually with runtime. If the temperature of the process gas leaving the primary heat exchanger apparatus exceeds a certain temperature, typically 400–450° C., the temperature of the tubes that transmit the process gas downstream of the primary heat exchanger will be so high that they may be damaged. Therefore, the apparatus has to be shut down in order to clean the tubes. The runtime of an apparatus after which the tubes have to be cleaned is referred to as 'cycle time'.

SUMMARY OF THE INVENTION

It is an object of the present invention to provide for an apparatus for heating steam in a heat exchanger for cooling a hot gas wherein the cycle time is maximised and/or the leakage problems are avoided. The hot gas is especially a hot process gas comprising compounds, which cause fouling of the heat exchange surfaces of the apparatus. Such compounds are especially soot and, optionally, sulphur. Reference herein to soot is to carbon and ash. This object has been met by an apparatus for heating steam formed from cooling water in a heat exchanger for hot gas, comprising a primary heat-exchanger vessel having a compartment for cooling water, an inlet for the gas to be cooled, an outlet for cooled gas, an outlet for heated steam and a collecting space for maintaining generated steam;

- at least one primary evaporator tube positioned in the compartment for cooling water and fluidly connected to the inlet for the gas to be cooled,
- at least one steam tube for withdrawal of generated steam from the collecting space for maintaining generated steam via a steam outlet of said collecting space,
- at least one secondary tube-shell heat exchanger vessel, 'super heater module', positioned in the compartment for cooling water, wherein the generated steam is further heated against partially cooled gas from the primary evaporator tube,
- wherein the primary evaporator tube is fluidly connected to the tube side of the super heater module and the steam tube for withdrawal of generated steam is fluidly connected to the shell side of the super heater module; and
- wherein means for adding water to the generated steam entering the super heater module are present.

BRIEF DESCRIPTION OF THE DRAWINGS

The invention will now be illustrated in more detail with reference to the accompanying drawings, in which should not be construed to limit the scope of the invention.

DETAILED DESCRIPTION OF THE INVENTION

It has now been found that by increasing the amount of water to the generated steam during the runtime the temperature of the hot gas leaving the primary heat exchange vessel can be kept below the critical temperature for a longer period. Thus an apparatus is obtained which can operate at a longer cycle time. Because of the addition of water to the steam the cooling capacity of the steam entering the superheater module is sufficient to operate the superheater module in a counter-current mode of operation while keeping the tube wall temperatures of the superheater below a maximum allowable temperature. Such maximum allowable temperatures are below about 650° C., preferably below about 500° C. Because the superheater can be operated in a counter-current operation high heat exchange efficiency can be achieved, resulting, for example, in that the amount of heated steam produced can be increased. Because the hot gas flows through the superheater module at the tube side a more easy to clean apparatus has furthermore been obtained. Cleaning can now be performed by for example passing a plug through the evaporator tubes and the tubes of the superheater, fluidly connected to said evaporator tube.

Reference to an evaporator tube is to one or more parallel tubes. Preferably, in order to minimize the size of the equipment, the evaporator tubes are coiled.

The means for adding water are preferably arranged such that water is added to the generated steam at a position between the steam outlet of the collecting space for generated steam and up to and including the super heater module. It is preferred that water is added in such a way that the occurrence of water droplets in the super heater module is avoided. Therefore, water may be added as steam, for example directly to said module. More preferably, the generated steam as obtained in the collecting space for generated steam is first heated, in suitably an auxiliary super heater module before liquid water is added to said generated steam. The liquid water will then immediately vaporize upon addition to the superheated steam.

Figure 1:
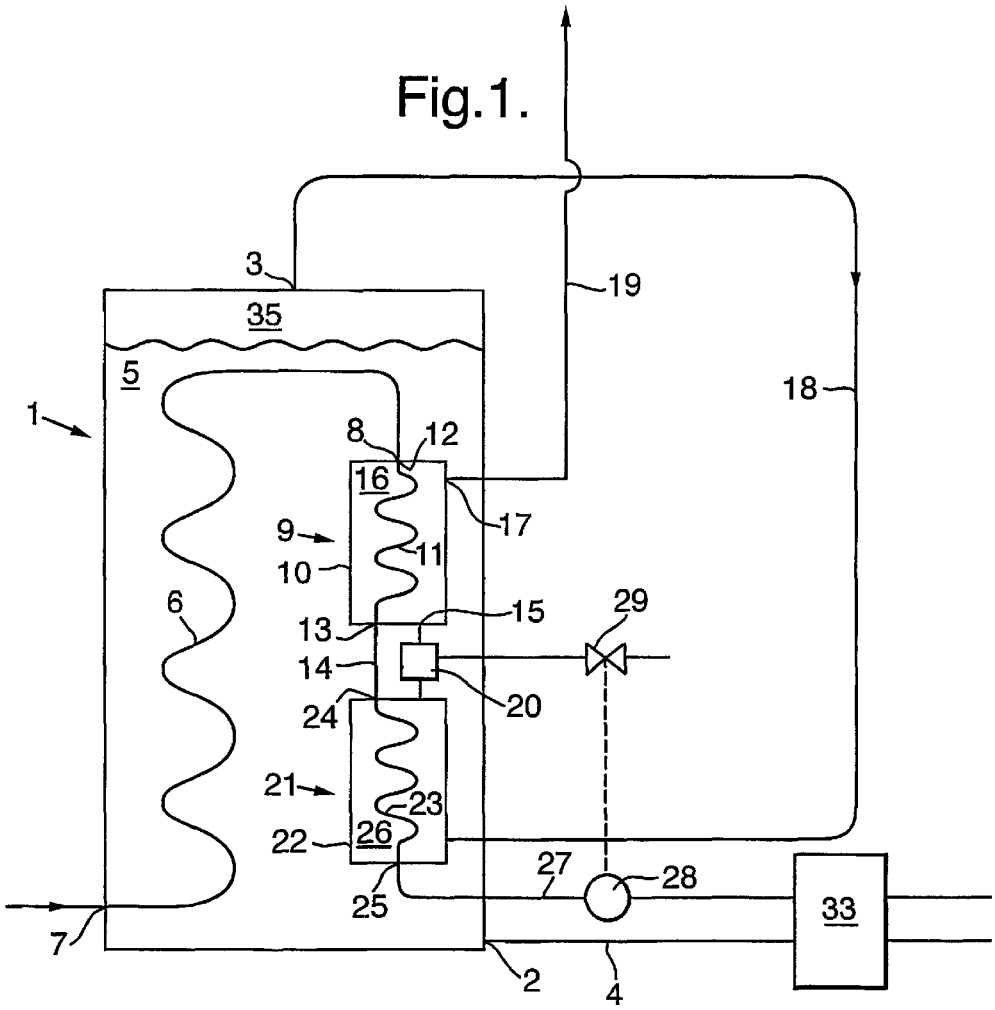
FIG. 1 shows schematically a longitudinal section of a first embodiment of the apparatus according to the invention.
Figure 2:
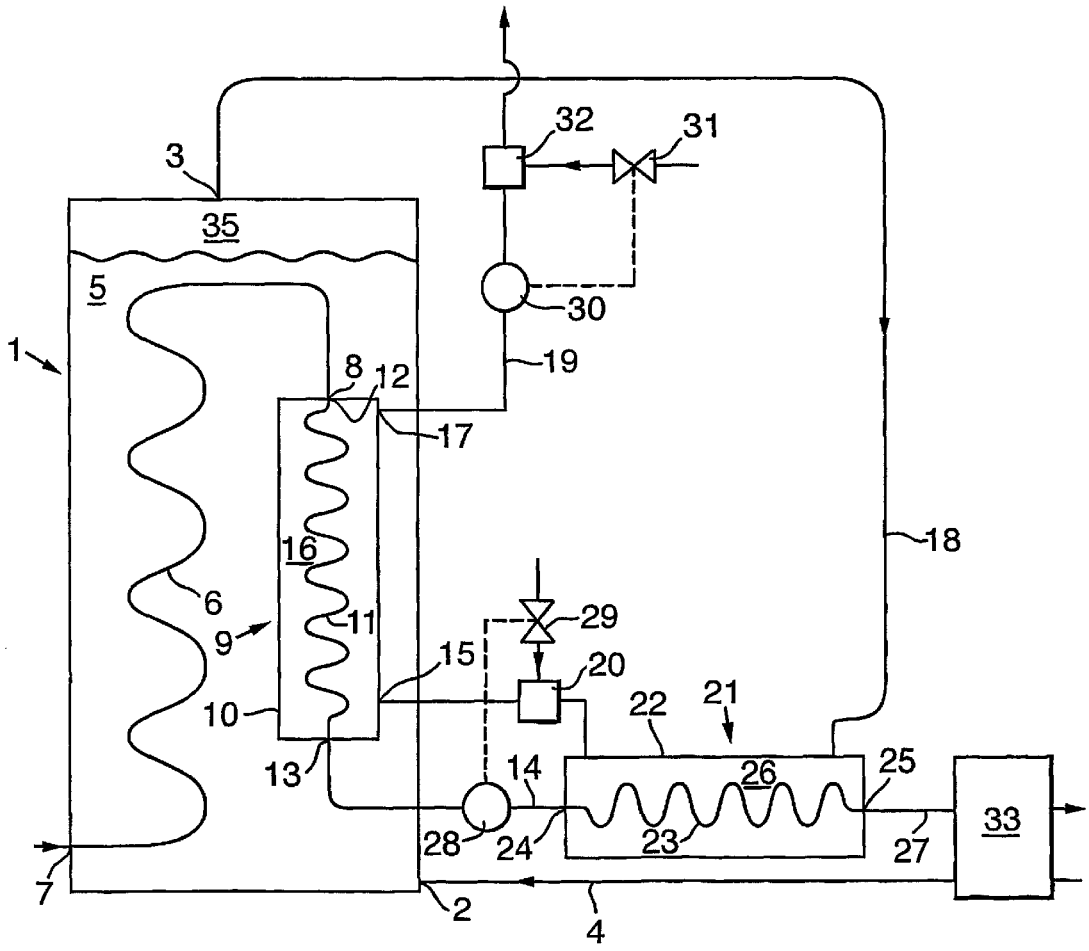
FIG. 2 shows schematically a longitudinal section of a second embodiment of the apparatus according to the invention.

Referring now to FIGS. 1 and 2, the apparatus according to the invention comprises a primary heat exchanger vessel 1 having an inlet 2 for cooling water, which inlet 2 opens into the interior of vessel 1. The vessel 1 further comprises a compartment for cooling water 5 and a collecting space 35 for maintaining generated steam. Collecting space 35 is provided with an outlet 3 fluidly connected to a steam tube 18 for withdrawal of generated steam. The steam tube 18 may be positioned inside or outside vessel 1. A suitable embodiment of how steam tube 18 may be positioned inside vessel 1 is illustrated by FIG. 1*a* of EP-A-257719. Preferably a mistmat (not shown) is present between outlet 3 and steam collecting space 35 in order to avoid water droplets from entering outlet 3. During normal operation, cooling water is supplied to vessel 1 via cooling water supply conduit 4, wherein the compartment for cooling water 5 of the vessel 1 is filled with cooling water. The apparatus comprises a primary evaporator tube bundle 6 having an inlet 7 for hot gas and an outlet 8. The primary evaporator tube bundle 6 is arranged in the compartment for cooling water 5. The apparatus further comprises a super heater module 9, comprising a vessel 10 containing a second tube bundle 11 having an inlet 12 communicating with the outlet 8 of the primary evaporator tube bundle 6 and an outlet 13. From outlet 13, the cooled gas is discharged via gas discharge conduit 14. The superheater vessel 9 has an inlet 15 for steam and an outlet 17 for superheated steam, both inlet 15 and outlet 17 are communicating with the shell side 16 of super heater module 9. Inlets 15 and 12 and outlets 17 and 13 are preferably arranged such that the hot gas and the steam flow substantially counter-current through a, preferably elongated, super heater module 9. The inlet 15 for steam is in fluid communication with the outlet 3 for steam of the heat exchanger vessel 1. Thus, the apparatus comprises a flow path for steam, extending from the outlet 3 for steam of vessel 1, via the inlet 15 for steam of vessel 10, through the shell side 16 of superheater 9 to the outlet 17 for superheated steam. From the outlet 17, the superheated steam is discharged via conduit 19.

The embodiments of the apparatus shown in FIGS. 1 and 2 comprise an auxiliary superheater 21 in order to heat the steam in the steam flow path before water is added by means 20. Suitable means for adding water are known in the art, such as a quench or the like. It will be appreciated that water may be added at more than one point in the flow path for steam.

The auxiliary superheater 21 comprises a vessel 22 containing a third tube bundle 23 having an inlet 24 communicating with the outlet 13 of superheater vessel 10 and an outlet 25. The shell side 26 of the auxiliary superheater 21 forms part of steam flow path. Cooled gas is discharged from outlet 25 via gas discharge conduit 27. Flow path, inlet 24 and outlet 25 are preferably arranged such that the hot gas and the steam flow substantially counter-current through a, preferably elongated, auxiliary superheater vessel 21.

Alternatively, the apparatus may comprise a single super heater module 9 and means 20 that are arranged such that the water is added to the shell side 16 of superheater 9.

The means 20 for adding water may be located inside or outside vessel 1. For practical purposes, especially to facilitate maintenance, it is preferred that means 20 are located outside the vessel 1, such as shown in FIG. 2.

During normal operation, the temperature of the gas in the gas discharge conduit downstream of vessel 1, i.e. conduit 27 in FIGS. 1 and 2, will gradually increase for a given throughput of hot gas, due to fouling of the primary evaporator and super heater tube bundles. By adding water to steam flow path, the period during which the temperature of the gas in gas discharge conduit 27 can be kept under a critical value, i.e. the value at which damage to conduit 27 will be likely, will be extended.

The temperature of the gas flowing in conduit 27 at a point just downstream of vessel 1 may be determined by a temperature measuring device 28. The measured data are fed to a control unit (not shown), which is controlling, by means of valve 29, the amount of water added to the steam flow path by means 20. Alternatively, the temperature of the gas flowing in conduit 27 may be determined by measuring the temperature of the superheated steam in conduit 19.

The temperature of the superheated steam discharged from the apparatus according to the present invention may be regulated by the addition of water. This reduces the temperature of the steam and simultaneously increases the amount of produced steam. FIG. 2 shows a preferred embodiment of how water can be added. As shown in FIG. 2, the temperature of the superheated steam discharged via conduit 19 is determined by means of a temperature measuring device 30. The measured data are fed to a control unit (not shown), which is controlling by means of valve 31 the amount of water added to conduit 19 by quench 32.

Preferably, the cooled gas in gas discharge conduit 27 (in an embodiment of the apparatus comprising an auxiliary superheater 21, such as shown in FIGS. 1 and 2) or in gas discharge conduit 14 (in an embodiment without auxiliary superheater (not shown)) is further cooled by heat exchange with the cooling water before it is entering the vessel 1. Therefore, the apparatus according to the invention preferably comprises an auxiliary heat exchanger 33 for cooling gas against cooling water, wherein the warm side of the auxiliary heat exchanger 33 is in fluid communication with the outlet 13 of the second tube bundle 11, or, if an auxiliary superheater 21 is present, with the outlet 25 of the third tube bundle 23, and the cold side of the auxiliary heat exchanger 33 is in fluid communication with the inlet 2 for cooling water of vessel 1.

The apparatus may further comprise one or more quenches (not shown) for quenching the hot gas with water or gas in order to cool the hot gas further. The quench may be located upstream or downstream the superheater 9.

The apparatus according to the invention is suitably further provided with a secondary evaporator tube fluidly connected to the hot gas outlet of the superheater module or, when present, the hot gas outlet of an auxiliary superheater. This secondary evaporator tube will further increase the period during which the temperature of the gas in gas discharge conduit 27 of the apparatus of this invention can be kept under a critical value as described above. The heat exchanging area's of primary and secondary evaporator tubes are suitably designed such that, in the begin of run, almost no heat exchange takes place by the secondary evaporator tube. Due to fouling of the inside of the evaporator and super heater tubes during the run the gas temperature in the secondary evaporator tube will gradually increase. The secondary evaporator tubes will then gradually start to participate in the cooling of the gas, thereby extending the period after which the temperature of the gas outlet conduit 27 reaches the above referred to critical value.

Figure 3:
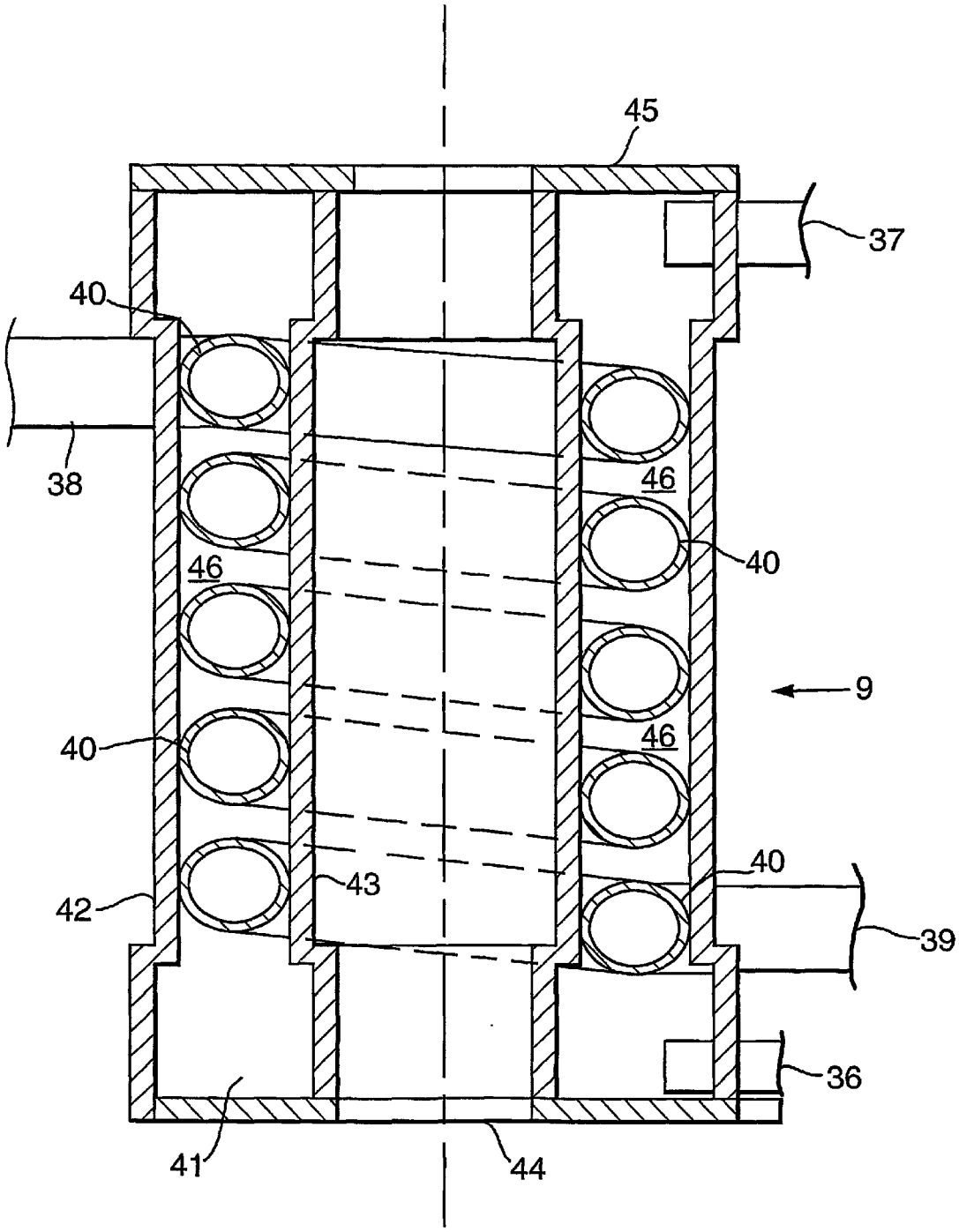
FIG. 3 shows a preferred superheater module which can find general application.

FIG. 3 shows a preferred super heater module 9 with an inlet 36 for steam, and outlet 37 for heated steam, an inlet 38 for hot gas and an outlet 39 for hot gas. The inlet 38 for hot gas is fluidly connected to a coiled tube 40. Coiled tube 40 is positioned in an annular space 41 formed by tubular outer wall 42 and tubular inner wall 43 and bottom 44 and roof 45. Tubular walls 42 and 43 are positioned against coiled tube 40 such that at the exterior (shell side) of the coiled tube and within the annular space 41 a spiral formed space 46 is formed. This spiral formed space 46 is fluidly connected at one end to steam inlet 36 and at its opposite end with steam outlet 37. Due to this configuration steam will flow via spiral space 46 counter-current with the hot gas which flows via coiled tube 40. For reasons of clarity only one coil 40 and one spiral space 46 is shown in FIG. 3. It will be clear that more than one parallel positioned coils and spirals can be placed in annular space 41. The heat exchanger as illustrated in FIG. 3 can find general application. It is advantageous because of its simple design and because almost 100% counter-current or co-current heat exchange can be achieved.

The apparatus according to the present invention is suitable for use in a process for superheating steam in a heat exchanger for cooling hot gas, preferably hot gas that is contaminated with mainly soot and/or sulphur. Accordingly, the present invention further relates to a process for heating steam performed in an apparatus as hereinbefore defined, wherein (a) steam is obtained by indirect heat exchange between liquid water and a hot gas,
(b) the steam obtained in step (a) is heated by indirect heat exchange with the partly cooled hot gas obtained in step (a),
(c) additional water is added to the steam obtained in step (a) prior to or during heating the steam in step (b).

The process is particularly suitable for the cooling of soot- and sulphur- containing synthesis gas produced by means of gasification of liquid hydrocarbonaceous feedstocks, preferably a heavy oil residue, i.e. a liquid hydrocarbonaceous feedstock comprising at least about 90% by weight of components having a boiling point above about 360° C., such as visbreaker residue, asphalt, and vacuum flashed cracked residue. Synthesis gas produced from heavy oil residue typically comprises about 0.1 to about 1.5% by weight of soot and about 0.1 to about 4% by weight of sulphur.

Due to the presence of soot and sulphur, fouling of the tubes transmitting the hot gas will occur and will increase with runtime, thereby impairing the heat exchange in the heat exchanger and the superheater. Preferably, the amount of water added by means 20 will be increased with runtime, preferably in such a way that the temperature of the hot gas at the point where the tubes transmitting it are leaving the heat exchanger vessel is kept below about 450° C.

The hot gas to be cooled in the process according to the invention has typically a temperature in the range of from about 1200 to about 1500° C., preferably from about 1250 to about 1400° C., and is preferably cooled to a temperature in the range of about 150 to about 450° C., more referably of from about 170 to about 300° C.

At least part of the superheated steam produced in the process according to the invention may advantageously be used in a process for the gasification of a hydrocarbonaceous feedstock. In such gasification processes, which are known in the art, hydrocarbonaceous feedstock, molecular oxygen and steam are fed to a gasifier and converted into hot synthesis gas. Thus, the present invention further relates to a process for gasification of a hydrocarbonaceous feedstock comprising the steps of (a) feeding the hydrocarbonaceous feedstock, a molecular oxygen-containing gas and steam to a gasification reactor,
(b) gasifying the feedstock, the molecular oxygen-containing gas, and the steam to obtain a hot synthesis gas in the gasification reactor,
(c) cooling the hot synthesis gas obtained in step (b) and heating steam according in an apparatus as hereinbefore defined, wherein at least part of the steam fed to the gasification reactor in step (a) is obtained in step (c).

We claim:

1. An apparatus for heating steam formed from cooling water in a heat exchanger for hot gas, comprising a primary heat-exchanger vessel having a compartment for cooling water, an inlet for the gas to be cooled, an outlet for cooled gas, an outlet for heated steam and a collecting space for maintaining generated steam;

at least one primary evaporator tube positioned in the compartment for cooling water and fluidly connected to the inlet for the gas to be cooled;

at least one steam tube for withdrawal of generated steam from the collecting space for maintaining generated steam via a steam outlet of said collecting space;

at least one superheater module, comprising a vessel positioned in the compartment for cooling water, wherein the generated steam is further heated against partially cooled gas from the primary evaporator tube;

wherein the primary evaporator tube is fluidly connected to the tube side of the super heater module and the steam tube for withdrawal of generated steam is fluidly connected to the shell side of the superheater module; and, wherein means for adding water to the generated steam entering the super heater module are present.

2. The apparatus of claim 1, wherein the means for adding water are arranged such that water is added to the generated steam at a position between the steam outlet of the collecting space for generated steam and the superheater module.

3. The apparatus of claim 1, wherein the means for adding water are means for adding liquid water.

4. The apparatus of claim 1, wherein the means for adding water and part of the steam tube for withdrawal of generated steam are arranged outside the primary heat exchanger vessel.

5. The apparatus of claim 1, wherein the compartment for cooling water also comprises a secondary evaporator tube for cooling of the hot gas, which secondary evaporator tube is positioned downstream, with respect to the flow of hot gas, of the superheater module.

6. The apparatus of claim 1, wherein an auxiliary superheater module for heating generated steam is located between the steam outlet of the collecting space for generated steam and the means for adding water.

7. The apparatus of claim 6, wherein the auxiliary super heater module is a tube-shell heat exchanger, arranged such that generated steam flows at the shell side and gas which has been partially cooled in at least the superheater module flows at the tube side.

8. The apparatus of claim 6, wherein the auxiliary superheater is arranged outside the primary heat exchanger vessel.

9. The apparatus of claim 1, wherein the apparatus further comprises means for adding water to the superheated steam downstream, with respect to the flow of steam, of the super heater module.

10. A process for heating steam performed in an apparatus, comprising a primary heat exchanger vessel having a compartment for cooling water, an inlet for the gas to be cooled, an outlet for cooled gas, an outlet for heated steam and a collecting space for maintaining generated steam;

at least one primary evaporator tube positioned in the compartment for cooling water and fluidly connected to the inlet for the gas to be cooled;

at least one steam tube for withdrawal of generated steam from the collecting space for maintaining generated steam via a steam outlet of said collecting space;

at least one superheater module, comprising a secondary tube-shell heat exchanger vessel positioned in the compartment for cooling water, wherein the generated steam is further heated against partially cooled gas from the primary evaporator tube;

wherein the primary evaporator tube is fluidly connected to the tube side of the superheater module and the steam tube for withdrawal of generated steam is fluidly connected to the shell side of the superheater module; and, wherein means for adding water to the generated steam entering the superheater module are present.

11. The process of claim 10, wherein the amount of water added to the flow path for steam is increasing with runtime.

12. The process of claim 10, wherein the hot gas is synthesis gas produced by gasification of a liquid or gaseous hydrocarbonaceous feedstock.

13. The process of claim 12, wherein synthesis gas is produced by gasification of a liquid hydrocarbonaceous feedstock comprising at least about 90% by weight of hydrocarbonaceous components having a boiling point above about 360° C.

14. The process of claim 10, wherein the hot gas comprises at least about 0.05% by weight of soot.

15. The process of claim 10, wherein the hot gas comprises at least about 0.1% by weight of sulphur, preferably at least about 0.2% by weight.

16. The process of claim 10, wherein the gas is cooled from a temperature in the range of from about 1200° C. to about 1500° C., to a temperature in the of from about 150° C. to about 450° C.

* * * * *